US006747416B2

(12) United States Patent
Barger et al.

(10) Patent No.: US 6,747,416 B2
(45) Date of Patent: Jun. 8, 2004

(54) FIELD EMISSION DISPLAY WITH DEFLECTING MEMS ELECTRODES

(75) Inventors: Jack Barger, San Diego, CA (US); James Qian Wang, San Diego, CA (US); Benjamin Edward Russ, San Diego, CA (US); Jean-Pierre Guillou, San Diego, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 10/349,260

(22) Filed: Jan. 21, 2003

(65) Prior Publication Data

US 2004/0007988 A1 Jan. 15, 2004

Related U.S. Application Data

(60) Provisional application No. 60/372,871, filed on Apr. 16, 2002.

(51) Int. Cl.[7] ..... G09G 3/10; G09G 3/20

(52) U.S. Cl. ..... 315/169.3; 345/75.2

(58) Field of Search ..... 315/164.1, 169.3; 313/310, 311; 345/75.2, 76

(56) References Cited

U.S. PATENT DOCUMENTS

| | | | | |
|---|---|---|---|---|
| 3,665,241 | A | 5/1972 | Spindt et al. | 313/351 |
| 5,019,003 | A | 5/1991 | Chasen | 455/24 |
| 5,053,673 | A | 10/1991 | Tomii et al. | 313/308 |
| 5,063,327 | A | 11/1991 | Brodie et al. | 445/24 |
| 5,216,324 | A | 6/1993 | Curtin | 313/495 |
| 5,245,247 | A | 9/1993 | Hosogi | 313/309 |
| 5,311,360 | A | 5/1994 | Bloom et al. | 359/572 |
| 5,340,997 | A | 8/1994 | Kuo | 257/10 |
| 5,448,133 | A | 9/1995 | Ise | 313/497 |
| 5,508,584 | A | 4/1996 | Tsai et al. | 313/497 |
| 5,528,103 | A | 6/1996 | Spindt et al. | 313/497 |
| 5,548,185 | A | 8/1996 | Kumar et al. | 313/495 |
| 5,556,316 | A | 9/1996 | Taylor et al. | 445/50 |
| 5,565,742 | A | 10/1996 | Shichao et al. | 315/366 |
| 5,619,097 | A | 4/1997 | Jones | 445/24 |
| 5,649,847 | A | 7/1997 | Haven | 313/461 |
| 5,773,921 | A | 6/1998 | Keesmann et al. | 313/309 |

(List continued on next page.)

OTHER PUBLICATIONS

Candescent Technologies, *ThinCRT Showcase*, http://www-.candescent.com/Candescent/showcase.htm, Jan. 16, 2001, pp. 1–4. Candescent Technologies Corporation.

Candescent Technologies, *ThinCRT Technology*, http://ww-w.candescent.com/Candescent/tcrttch.htm, Jan. 16, 2001, pp. 1–3, Candescent Technologies Corporation.

Candescent Technologies, *The ThinCRT Concept*, http://www.candescent.com/Candescent/tcrtcnpt.htm, Jan. 16, 2001, pp. 1–6, Candescent Technologies Corporation.

(List continued on next page.)

*Primary Examiner*—Don Wong
*Assistant Examiner*—Minh Dieu A
(74) *Attorney, Agent, or Firm*—Thomas F. Lebens; Fitch, Even, Tabin & Flannery

(57) ABSTRACT

An electron emitting structure having deflectable electrodes, such as found in grating light valves (GLVs) is provided. In one implementation, the structure includes a substrate having base electrodes and gate electrodes coupled thereto and insulated from each other, and an emitting material deposited on active regions of the base electrodes. Upon applying a voltage potential difference between a base electrode and a gate electrode, a portion of one of the base electrode and the gate electrode deflects through electrostatic force positioning the portion of the one of the base electrode and the gate electrode relative to another one of the base electrode and the gate electrode such that an electric field is produced that is sufficient to cause an emission from an emitting material deposited on the base electrode. In preferred form, lower drive voltages are required to provide the electric field without requiring sub-micron spacing between electrodes.

31 Claims, 8 Drawing Sheets

U.S. PATENT DOCUMENTS

| | | | | |
|---|---|---|---|---|
| 5,811,926 | A | 9/1998 | Novich | 313/495 |
| 5,834,891 | A | 11/1998 | Novich | 313/495 |
| 5,880,554 | A | 3/1999 | Liu | 313/309 |
| 5,910,704 | A | 6/1999 | Choo | 313/495 |
| 5,962,959 | A | 10/1999 | Iwasaki et al. | 313/310 |
| 5,986,390 | A | 11/1999 | Chuman et al. | 313/310 |
| 6,004,912 | A | 12/1999 | Gudeman | 508/577 |
| 6,039,622 | A | 3/2000 | Kosaka et al. | 445/52 |
| 6,064,148 | A | 5/2000 | Tolt et al. | 313/495 |
| 6,066,922 | A | 5/2000 | Iwasaki et al. | 315/169.3 |
| 6,094,001 | A | 7/2000 | Xie | 313/309 |
| 6,097,138 | A | 8/2000 | Nakamoto | 313/309 |
| 6,144,144 | A | 11/2000 | Cleeves et al. | 313/309 |
| 6,146,230 | A | 11/2000 | Kim et al. | 445/51 |
| 6,149,484 | A | 11/2000 | Amrine et al. | 313/495 |
| 6,323,831 | B1 | 11/2001 | Ono et al. | 345/75.2 |
| 6,359,383 | B1 | 3/2002 | Chuang et al. | 313/496 |
| 6,377,002 | B1 | 4/2002 | Ge et al. | 315/366 |
| 6,509,677 | B2 | 1/2003 | Xia et al. | 313/309 |
| 6,515,429 | B2 * | 2/2003 | Russ et al. | 315/169.3 |
| 6,559,602 | B2 * | 5/2003 | Russ et al. | 315/169.1 |
| 6,590,320 | B1 | 7/2003 | Abanshin et al. | 313/309 |
| 6,624,590 | B2 * | 9/2003 | Russ et al. | 315/169.3 |
| 2001/0028215 | A1 | 10/2001 | Kim | |
| 2002/0047559 | A1 | 4/2002 | Frayssinet et al. | 315/169.3 |
| 2002/0185950 | A1 | 12/2002 | Russ et al. | |
| 2002/0185951 | A1 | 12/2002 | Russ et al. | |
| 2002/0185964 | A1 | 12/2002 | Russ et al. | |
| 2002/0187706 | A1 | 12/2002 | Russ et al. | |
| 2002/0187707 | A1 | 12/2002 | Russ et al. | |
| 2002/0195959 | A1 | 12/2002 | Russ et al. | |

OTHER PUBLICATIONS

Candescent Technologies, *Candescent ThinCRT Technology Primer*, http://www.candescent.com/Candescent/techprim-.htm, Jan. 16, 2001, pp. 1–5, Candescent Technologies Corporation.

Gudeman, Christopher, *Diffractive Optical MEMs Use Grating Light Value Technique, EETimes*, Mar. 18, 2002, pp. 1–4, www.eetimes.com/in_focus/communications/OEG20020315S0047.

Bloom, D.M., *The Grating Light Valve: revolutionizing display technology*, 21 pgs., Oct. 1, 2002, http://www.siliconlight.com/webpdf/pw97.pdf.

Ito et al., *Carbon–Nanotube–Based Triode–Field–Emission Displays Using Gated Emitter Structure*, IEEE Electron Device Letters, Sep. 2001, pp. 426–428, vol. 22, No. 9.

* cited by examiner

Off State

On State

Off State

On State

FIELD EMISSION DISPLAY WITH DEFLECTING MEMS ELECTRODES

This application claims priority under 35 U.S.C. §119(e) to U.S. Provisional Patent Application No. 60/372,871, filed Apr. 16, 2002, of Barger; et al., for MEMS FED, which U.S. Provisional Patent Application is incorporated herein by reference.

BACKGROUND OF THE INVENTION

1. Field of the Invention

The present invention relates generally to flat panel displays (FPDs), and more specifically to field emission displays (FEDs) and grating light valves (GLVs). Even more specifically, the present invention relates to the cathode structure of a field emission display (FED).

2. Discussion of the Related Art

A field emission display (FED) is a low power, flat cathode ray tube type display that uses a matrix-addressed cold cathode to produce light from a screen coated with phosphor materials. FIG. 1 is a side cut-away (cross sectional) view of a conventional FED. The FED 100 includes a cathode plate 102 and an anode plate 104 (or face plate), which opposes the cathode plate 102. The cathode plate 102 includes a cathode substrate 106, cathode electrodes (cathode electrode 107 is illustrated) printed on the substrate 106, a dielectric layer 108 disposed on the cathode substrate 106 and the cathode electrode 107, and a gate electrode 114 disposed on the dielectric layer 108 and several emitter wells 110 formed within the gate electrode 114 and the dielectric layer 108. An electron emitter 112 is deposited within each emitter well 110, the emitters 112 shaped as conical electron emitters, e.g., Spindt tips.

The anode plate 104 includes a transparent substrate 116 (face plate or display face) upon which is formed various phosphors (e.g., red, green and blue) that oppose the electron emitters 112, for example, a red phosphor 120 is illustrated. A thin metallic anode 118 is formed over the phosphors, e.g., phosphor 120.

It is important that the cathode plate 102 and the opposed anode plate 104 be maintained insulated from one another at a relatively small, but uniform distance from one another throughout the full extent of the display face in order to prevent electrical breakdown between the cathode plate and the anode plate, provide a desired thinness, and to provide uniform resolution and brightness. Additionally, in order to allow free flow of electrons from the cathode plate 102 to the phosphors and to prevent chemical contamination, the cathode plate 102 and the anode plate 104 are sealed within a vacuum. In order to maintain a uniform separation between the cathode plate 102 and the anode plate 104 across the dimensions of the FED in the pressure of the vacuum, structurally rigid spacers (not shown) are positioned between the cathode plate 102 and the anode plate 104.

The FED 100 operates by selectively applying a voltage potential between the cathode electrode 107 and the gate electrode 114, producing an electric field 122 focused to cause a selective electron emission 124 from the tips of the electron emitters 112. The emitted electrons are accelerated toward and illuminate the phosphor 120 of the anode 118 by applying a proper potential to the anode 118. The anode potential must be high enough that the electrons penetrate through the anode 118 to illuminate the phosphors. One problem with known FEDs is that a high electric field is necessary to drive the device. Thus, designers use a very high drive voltage or use sub-micron spacing between the cathode electrode 107 and the gate electrode 114, which may lead to crosstalk and increases the cost of the FED.

A grating light valve (GLV) is micromachined diffraction grating that acts as a spatial light modulator (SLM) to vary how light is reflected from each of multiple deflecting ribbon-like structures and are commonly used projection elements. A conventional GLV 10, such as described in U.S. Pat. No. 5,311,360, issued May 10, 1994 to Bloom et al., entitled METHOD AND APPARATUS FOR MODULATING A LIGHT BEAM, is illustrated in FIGS. 2, 3 and 4. A pattern of deformable elements 18 (typically ribbons) are formed in a spaced relationship over a substrate 16 having an electrode 24 formed on the base of the substrate 16. The elements 18 and the substrate 16 are coated with a reflective material 22. In FIG. 3, the grating 10 is shown in a non-diffracting state with no voltage applied between the electrode 24 of the substrate 16 and the individual elements 18, and with a lightwave 26 incident upon it. The height difference between the reflective material 22 on the elements 18 and on the substrate 16 is designed to be $\lambda/2$ of the incident lightwave 26 when the deformable elements 18 are in a relaxed state (FIG. 3), such that light reflected from the elements 18 and from the substrate 16 add in phase and the grating 10 acts to reflect the incident lightwave 26 as a flat mirror.

However, as illustrated in FIG. 4, when a voltage is applied between the elements 18 and the electrode 24 of the substrate 16, the electrostatic forces pull the elements 18 down onto the substrate 16, with the result that the distance between the top of the elements 18 and the top of the substrate 16 is now $\lambda/4$ of the incident lightwave 26. Thus, the total path length difference for the light reflected from the elements 18 and from the substrate 16 is now $\lambda/2$ of the incident lightwave and the reflections interfere destructively, causing the light to be diffracted, indicated as 28. By using this grating 10 in combination with a system, for detecting the reflected light, which has a numerical aperture sized to detect one order of diffracted light from the grating, the grating 10 can used to be modulate the reflected light with high contrast in order to create a projection display.

Typically, the elements 18 are formed by depositing a layer of conducting material over an insulating layer 11 formed on a substrate, then etching away the elements 18 and portions of the insulating layer 11 such that the remaining portions of the conducting material form the elements 18. However, the entire conducting layer is not etched away, in order to form a frame 20 that the elements 18 are tensioned between and which is supported above the substrate 16 by the remaining portions of the insulating layer 11.

SUMMARY OF THE INVENTION

The invention provides an electron emitting structure that uses a field emission display (FED)-like cathode in combination with deflecting electrodes or deflecting ribbons, such as used in grating light valves (GLVS) to produce various electron emitting structures. In a preferred form, the electron emitting structure is used as a cathode plate of an FED, which advantageously, provides lower drive voltages in order to provide an electric field sufficient to produce an electron emission without requiring sub-micron spacing between electrodes.

In one embodiment, the invention can be characterized as an electron emitting structure comprising a substrate having base electrodes and gate electrodes coupled thereto, an insulating material separating and electrically insulating the base electrodes and the gate electrodes, and an electron emitting material deposited on active regions of the base electrodes. Upon applying a voltage potential difference between a respective base electrode and a respective gate electrode, a portion of one of the respective base electrode and the respective gate electrode deflects through electrostatic force positioning the portion of the one of the respective base electrode and the respective gate electrode relative to another one of the respective base electrode and the respective gate electrode such that an electric field is produced at a respective active region sufficient to cause an electron emission from a respective electron emitting material deposited on the respective active region.

In another embodiment, the invention can be characterized as a method of electron emission comprising the steps of: applying a voltage potential difference between a base electrode and a gate electrode of an electron emitting structure, the base electrode electrically insulated from the gate electrode; deflecting, as a result of the applying step, a portion of one of the base electrode and the gate electrode to position the portion of the one of the base electrode and the gate electrode relative to another one of the base electrode and the gate electrode; and producing, as a result of the applying and deflecting steps, an electric field at an active region of the base electrode sufficient to cause an electron emission from an electron emitting material on the active region.

In a further embodiment, the invention may be characterized as a field emission display comprising a cathode plate and an anode plate. The cathode plate comprises a substrate having base electrodes and gate electrodes coupled thereto, an insulating material separating and electrically insulating the base electrodes and the gate electrodes, and an electron emitting material deposited on active sub-pixel regions of the base electrodes. Upon applying a voltage potential difference between a respective base electrode and a respective pair of gate electrodes, a portion of one of the respective base electrode and the respective pair of gate electrodes deflects through electrostatic force positioning the portion of the one of the respective base electrode and the respective pair of gate electrodes relative to another one of the respective base electrode and the respective pair of gate electrodes such that an electric field is produced at a respective active region sufficient to cause an electron emission from a respective electron emitting material deposited on the respective active region. The anode plate comprises a transparent substrate separated above the cathode plate and phosphor material coupled to the transparent substrate, portions of the phosphor material corresponding to active sub-pixel regions of the base electrodes, the electron emission illuminating a respective portion of the phosphor material.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

Figure 1:
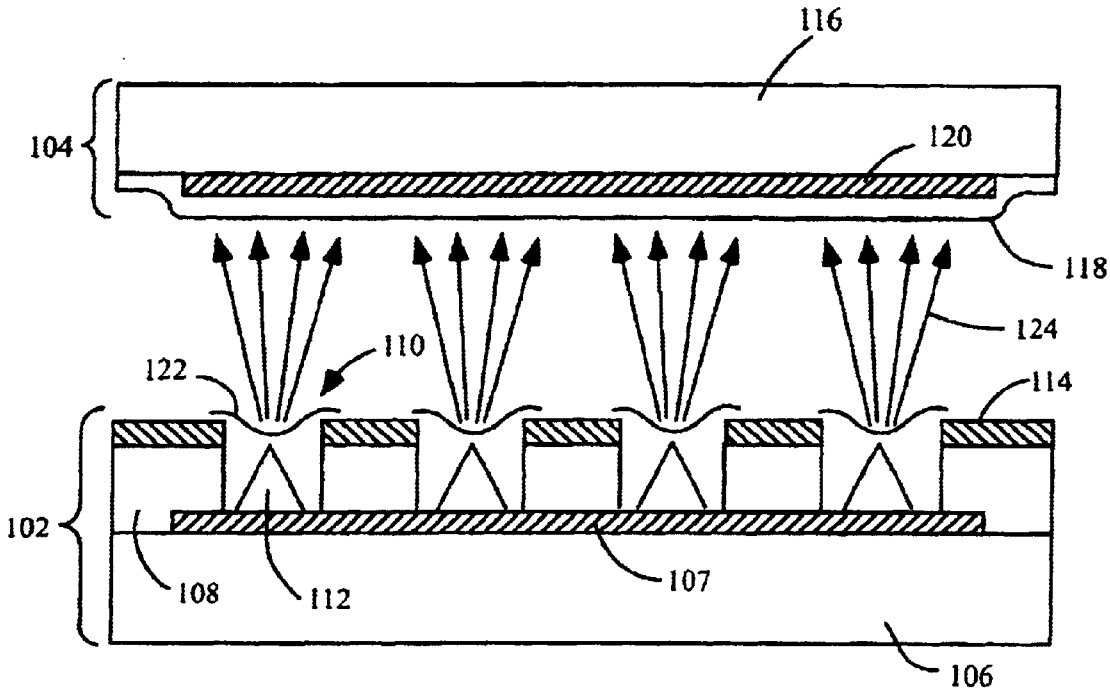
FIG. 1 (Prior Art)
FIG. 1 is a cross sectional view of a conventional field emission display (FED).

The following description is not to be taken in a limiting sense, but is made merely for the purpose of describing the general principles of the preferred embodiments. The scope of the invention should be determined with reference to the claims.

According to several embodiments of the invention, an electron emitting structure is provided that uses a field emission display (FED)-like cathode in combination with deflecting electrodes or deflecting ribbons, such as used in grating light valves (GLVs) to produce various electron emitting structures. In a preferred form, the electron emitting structure is used as a cathode plate of a field emission display (FED), which advantageously, provides lower drive voltages in order to provide an electric field sufficient to produce an electron emission without requiring sub-micron spacing between electrodes. Accordingly, an electron emitting structure is provided which includes base electrodes (also referred to as cathode lines) and gate electrodes formed over a substrate. The gate electrodes are separated and electrically insulated from the base electrodes by a suitable dielectric or insulating material. An electron emitting material is deposited on active regions of the base electrodes. In preferred embodiments, one of the base electrodes and the gate electrodes are formed from deflecting ribbon Micro-ElectroMechanical System (MEMS) elements, such as used in conventional spatial light modulator (SLM) GLVs. However, generically, at least a portion of the one of the base electrodes and the gate electrodes is made deflectable or deformable.

Upon the application of an appropriate voltage potential between a given base electrode and a given gate electrode (i.e., an "on" state), the deflecting one of the base electrode and the gate electrode is caused to deflect or bend relative to the non-deflecting one of the base electrode and the gate electrode due to electrostatic force. Once deflected, the distance between a deflected portion of one of the base electrode and the gate electrode is changed to modify an electric field produced by the voltage potential at an active region of the base electrode. Once deflected, the electric field is sufficient to cause an electron emission from a given electron emitting material deposited on a given active region of the base electrode. Advantageously, since the distance between the base electrode and the gate electrode has changed, in comparison to conventional FEDs in which the spacing between the base and gate electrodes is fixed, the electric field produced on the active region is at a level as if the base and gate electrodes were fixed at the new distance, but without requiring that the base and gate electrodes be manufactured and fixed at the new distance. This results in lower drive voltages while the spacing between base and gate electrodes is not required to be on a sub-micron scale. Additionally, in preferred embodiments, in an "off" state with no deflection, the base and gate electrodes are maintained at a distance that does not cause crosstalk at adjacent active regions.

Depending on the embodiment, base electrodes are fixed and gate electrodes deflect, while in other embodiments, the base electrodes deflect and the gate electrodes are fixed. Furthermore, depending on the embodiment, the deflecting electrode may be deflected towards the non-deflecting electrode or away from the non-deflecting electrode. However, generally, the separation or distance between the base and gate electrodes is altered through deflection of the deflecting electrode relative to the non-deflecting electrode, which results in the modification of the electric field produced at an active region of the base electrode. Generally, this modification is a geometric amplification of the electric field at the active region in the deflected or on state in comparison to the electric field produced at the active region in the non-deflected or off state.

Figure 5:
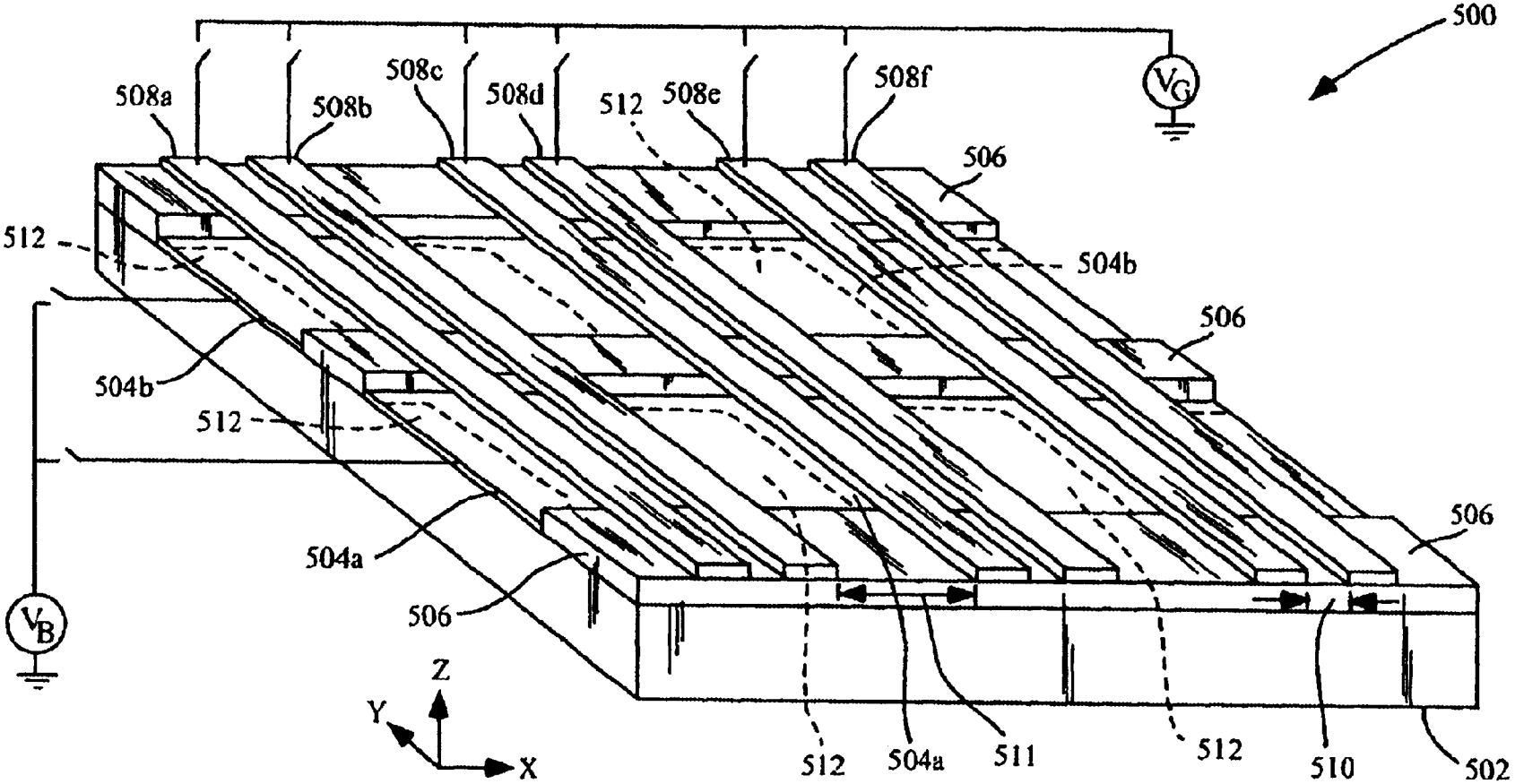
FIG. 5 is a perspective view of a portion of an electron emitting structure used for example, as a cathode plate of a field emission display (FED), in accordance with the present invention including deflecting gate electrodes crossing over base electrodes formed on a substrate and separated from the gate electrodes by an insulating material formed on the substrate.

Referring next to FIG. 5, a perspective view is shown of a portion of an electron emitting structure used for example, as a cathode plate of a field emission display (FED), in accordance with the present invention. FIGS. 6A–8B, will also be referred to while referred to FIG. 5.

Figure 6A:
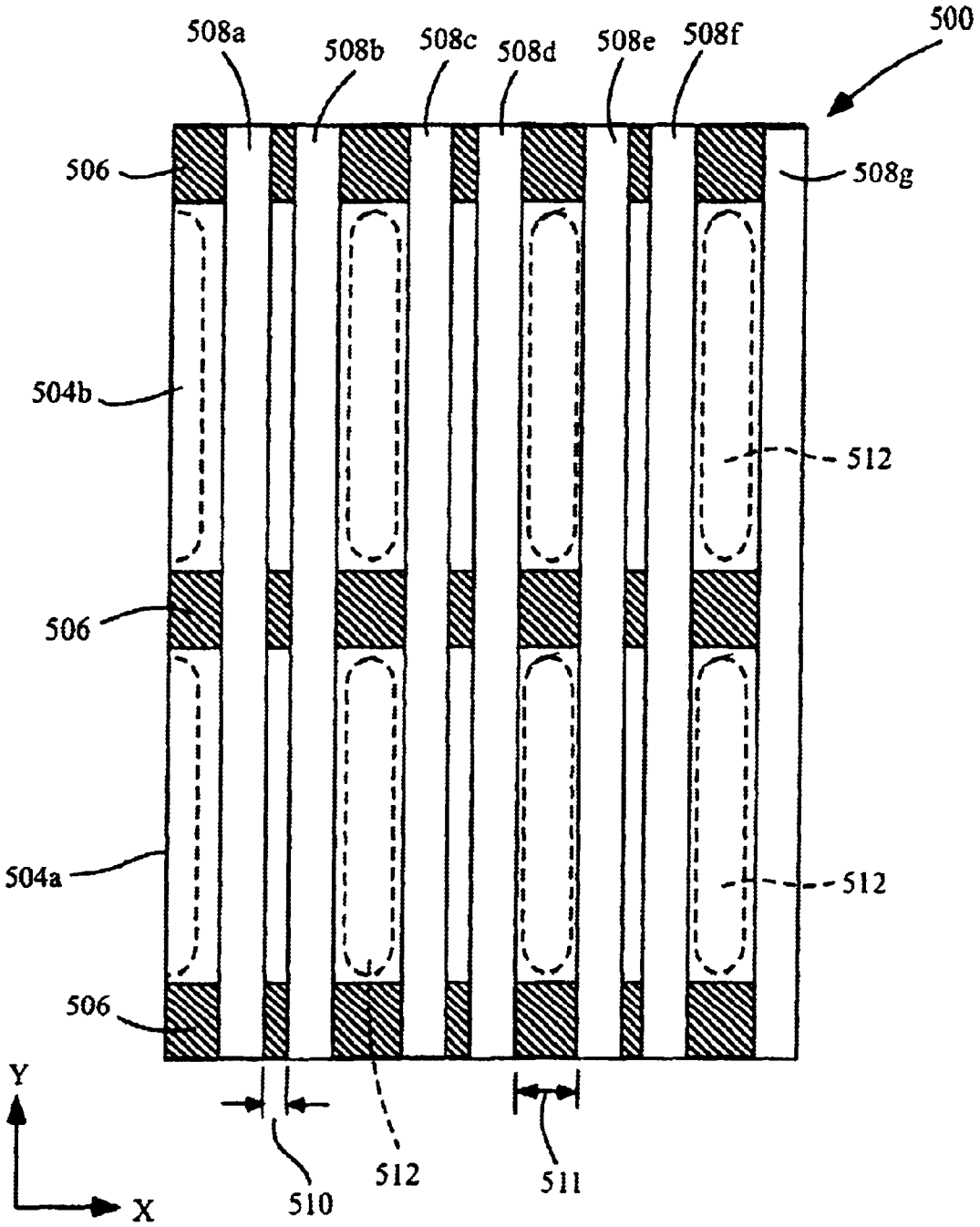
FIG. 6A is a plan view of the electron emitting structure of FIG. 5.
Figure 6B:
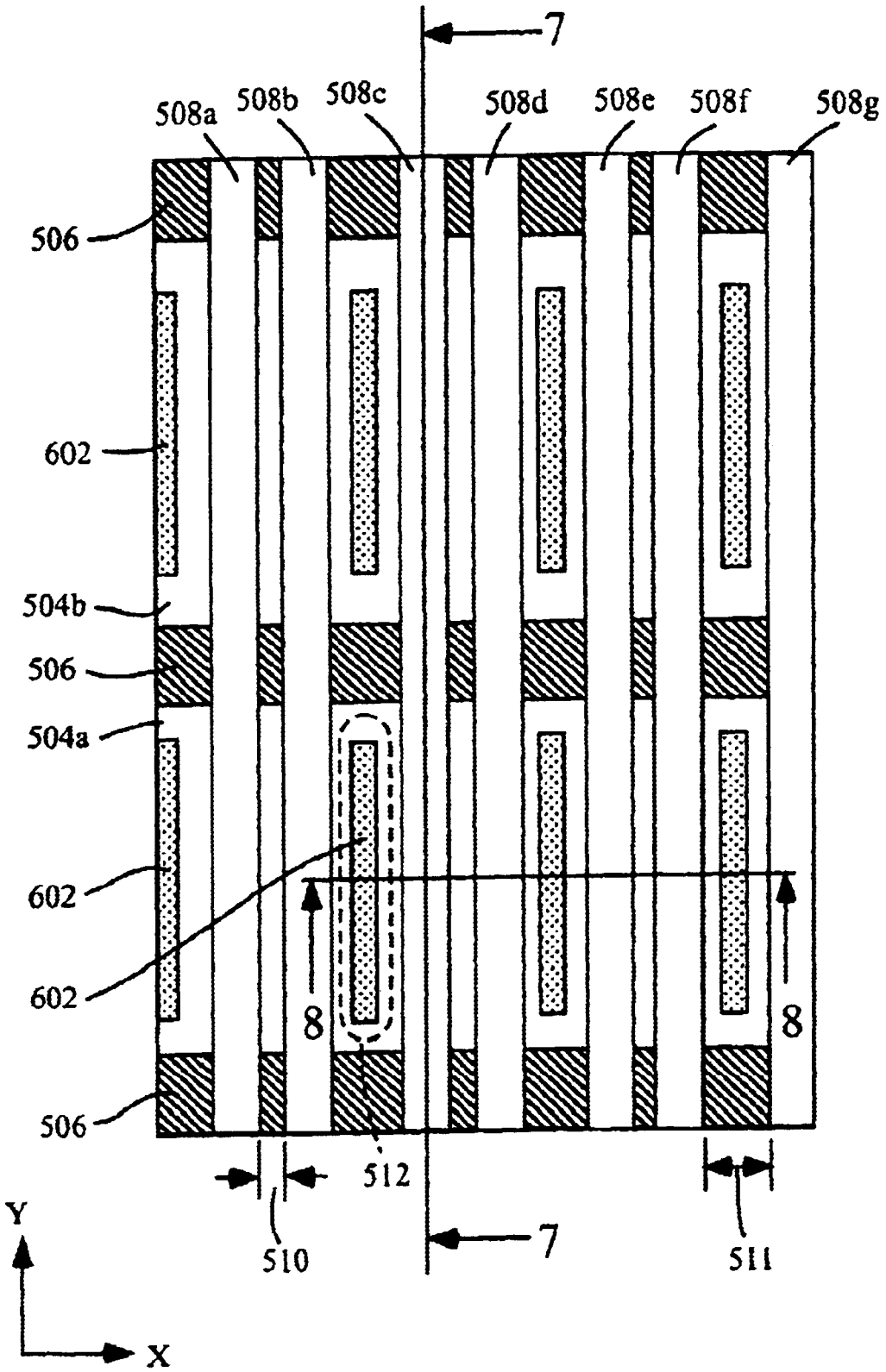
FIG. 6B is a plan view of the electron emitting structure of FIG. 6A including electron emitting material deposited on active regions of the base electrodes.
Figure 7A:
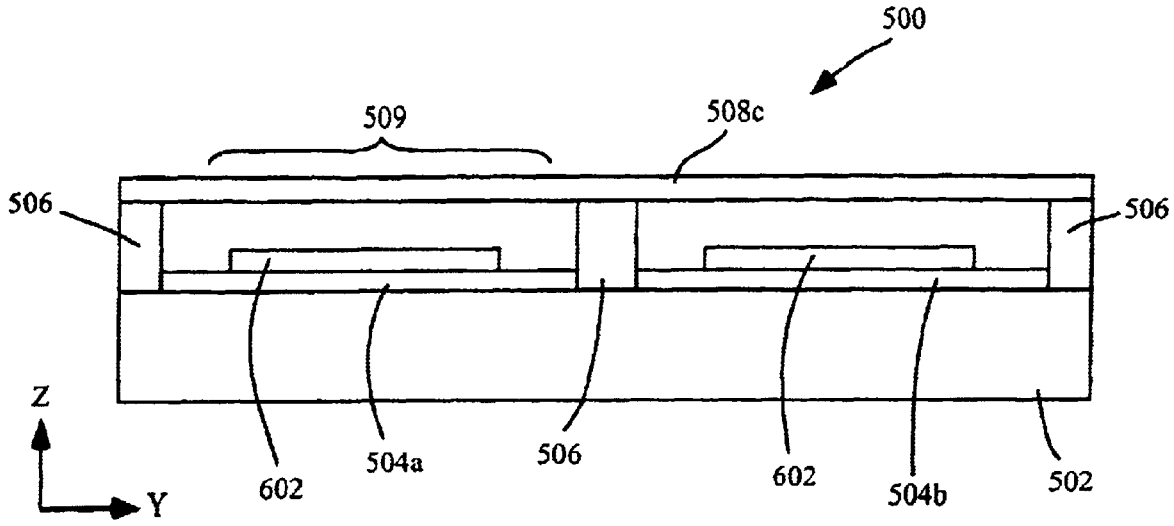
FIGS. 7A and 7B are cross sectional views of the electron emitting structure of FIGS. 5–6B taken along line 7—7 of FIG. 6B in an "off" or undeflected state and in an "on" or deflected state, respectively, in accordance with an embodiment of the invention.
Figure 7B:
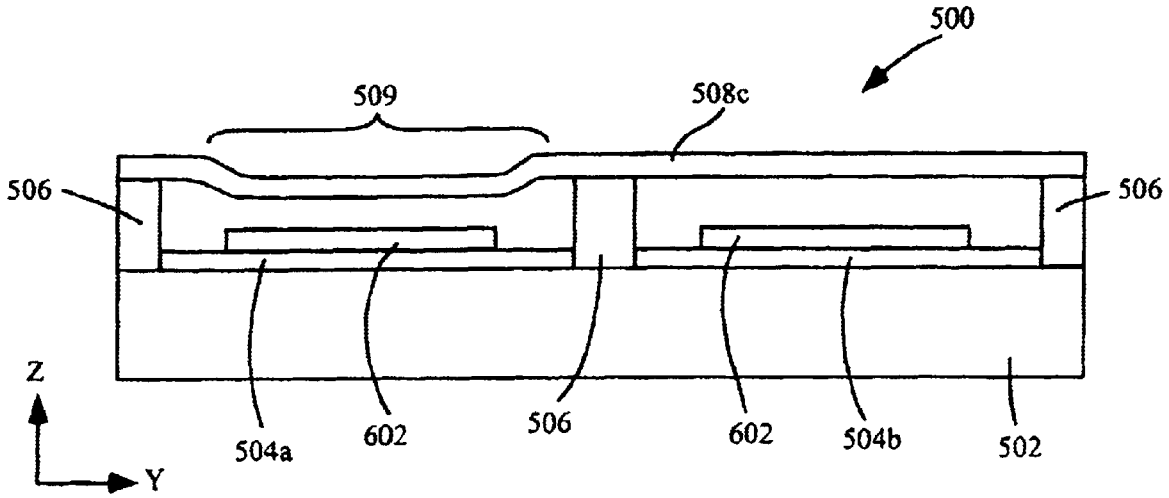
Figure 8A:
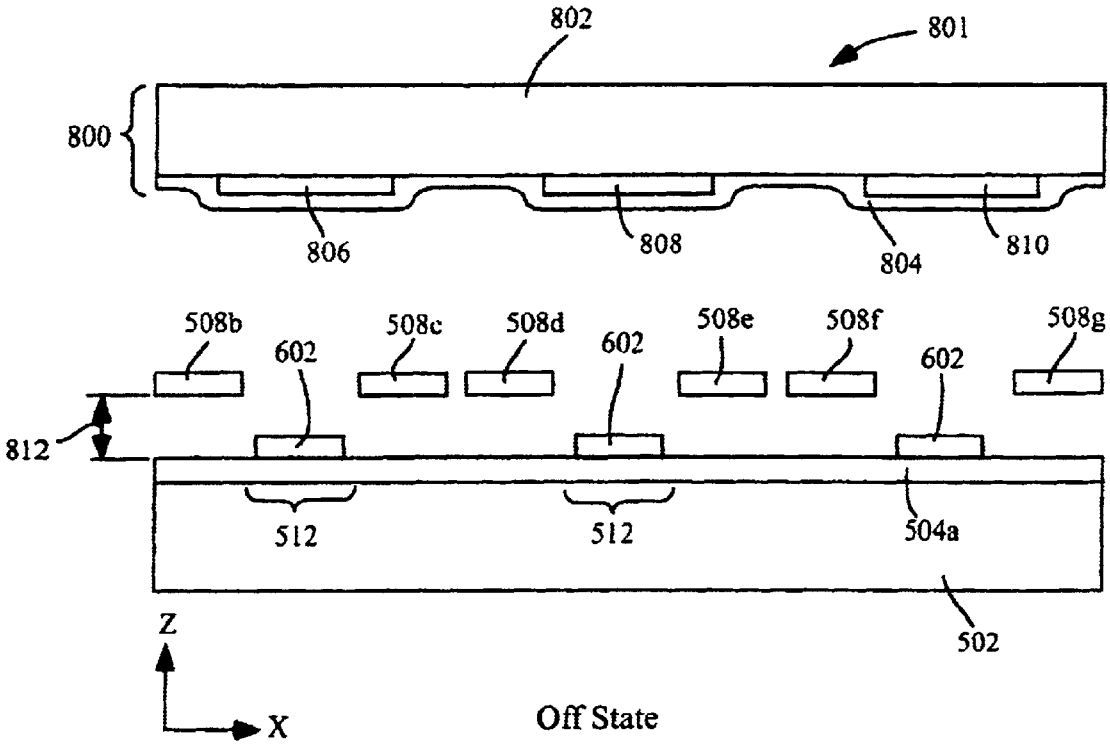
FIGS. 8A and 8B are cross sectional views of an FED using the electron emitting structure of FIGS. 5–7B taken along line 8—8 of FIG. 6B in the "off" and "on" states, respectively, further illustrating an anode plate and a resulting electron emission in accordance with an embodiment of the invention.
Figure 8B:
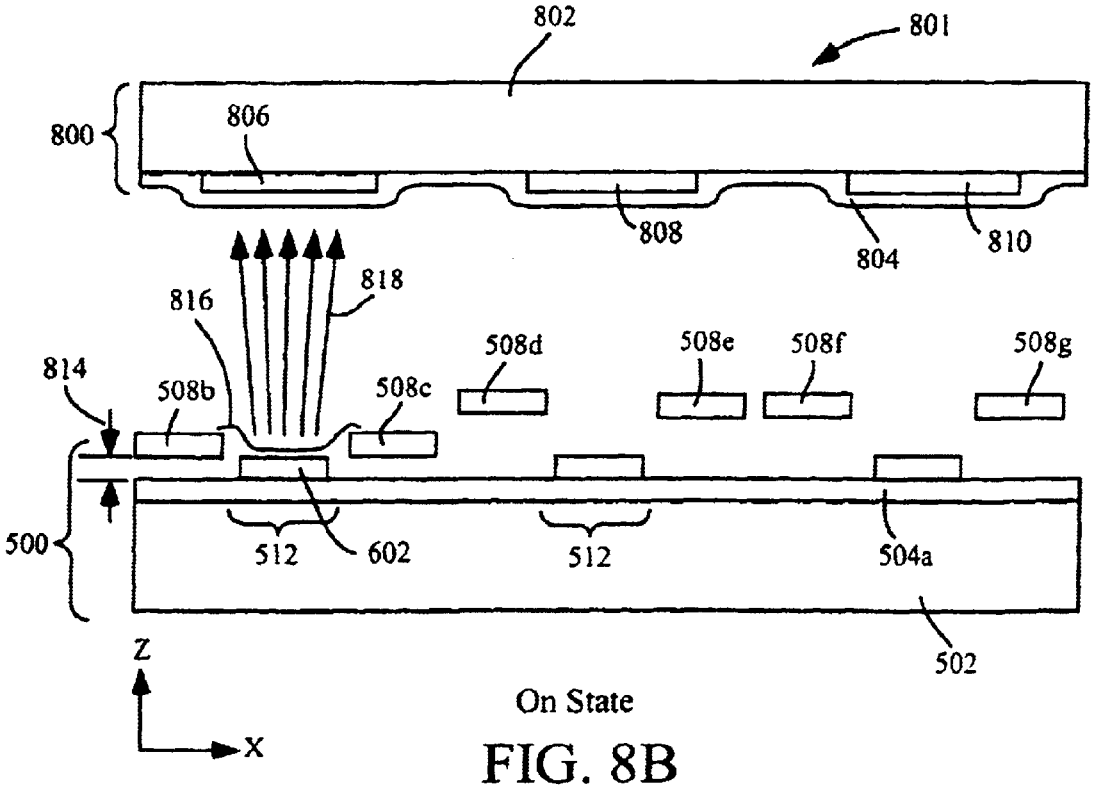

While referring to FIG. 5, concurrent reference will be made to FIGS. 6A through 8B, which illustrate a plan view of the electron emitting structure of FIG. 5. FIGS. 6A and 6B illustrate a plan view of the electron emitting structure of FIG. 5, while FIGS. 7A and 7B illustrate a cross sectional view of the structure of FIG. 6B taken along line 7—7. FIGS. 8A and 8B illustrate a cross sectional view of the emitting structure of FIG. 6B taken along line 8—8 and as used as an FED.

An electron emitting structure 500 or plate including a substrate 502, base electrodes 504 (also referred to as cathode electrodes or cathodes of an FED, individual base electrodes 504 illustrated as 504*a* and 504*b*) printed on the substrate 502, and gate electrodes 508 (also referred to as gates of an FED, individual gate electrodes 508 illustrated as 508*a*, 508*b*, 508*c*, 508*d*, 508*e*, 508*f* and 508*g* (508*g* is illustrated in FIGS. 6A, 6B, 8A and 8B)) crossing over the base electrodes 504. The base electrodes 504 are embodied as lines of conductive metallic material. The gate electrodes 508 are separated and electrically insulated from the base electrodes 504 by an insulating material, which is embodied as insulating members 506 (also referred to as ribs, ridges, barriers or lines) of a dielectric material formed over the substrate 502. Additionally, it is noted that portions of the substrate 502 material may also generally function as an insulating or dielectric material. Preferably, as illustrated, the insulating members 506 are linear ribs that are formed in between adjacent linear base electrodes 504. It should be understood that the insulating material may take on many alternative geometries than the illustrated linear insulating members 506. The gate electrodes 508 cross over the insulating material and the base electrodes 504 while contacting the insulating material. The gate electrodes 508 are preferably embodied as ribbons or lines of conductive material. Active regions 512 (also referred to as cathode sub-pixel regions of an FED) of the base electrodes 504 are those regions of the base electrode 504 that an electron emitting material may be deposited. In this embodiment, the gate electrodes 504 comprise deflecting gate electrodes similar to deflecting ribbon MEMS elements, such as used in conventional GLVs.

In the illustrated embodiment, the base electrodes 504 extend substantially parallel to each other across the substrate 502. In preferred form, the base electrodes 504 form rows extending across the substrate 502. The linear insulating members 506 extend across the substrate 502 substantially parallel to each other and formed in between respective base electrodes 504. Thus, according to one embodiment, the linear insulating members 506 resemble linear ribs, barriers or ridges of dielectric material formed in between linear base electrodes 504.

The gate electrodes 508 generally cross over the base electrodes 504 and are held above the base electrodes by the insulating members 506. Preferably, the gate electrodes 508 cross over and are perpendicular to the base electrodes 504. In preferred form, the gate electrodes 508 form columns extending across the base electrodes 504. Additionally, in this embodiment, the gate electrodes 508 are non-uniformly spaced across the base electrodes 504.

According to several embodiments of the invention, each gate electrode 508 is a conductive material deflecting ribbon, such as a deflecting MEMS ribbon of a conventional GLV, crossing over the base electrodes 504 and the insulating members 506 while contacting an upper surface of the insulating members 506. In this embodiment, the gate electrodes 508 are deflecting electrodes (i.e., the gate electrodes have deflecting portions) while the base electrodes 504 are non-deflecting electrodes. Generally, in operation, portions of the deflecting gate electrodes 508 bend or deflect towards the base electrode 504 underneath, as will be described in more detail below. Thus, the insulating members 506 provide mechanical support for the gate electrodes above the base electrodes.

Generally, the active regions 512 (also referred to as cathode sub-pixel regions in an FED) of each base electrode 504 are regions where an electron emitting material is deposited and are defined in this embodiment, as the regions of the base electrodes 504 below and in between a respective pair of gate electrodes 508, e.g., the region of the base electrode 504 in between gate electrodes 508*b* and 508*c* and in between gate electrodes 508*d* and 508*e*. In the illustrated embodiment, the active regions are also defined the regions of the base electrodes 504 below and in between a respective pair of gate electrodes 508 and in between adjacent insulating members 506, e.g., the region of the base electrode 504 in between gate electrodes 508*b* and 508*c* and in between adjacent insulating members 506.

Figure 2:
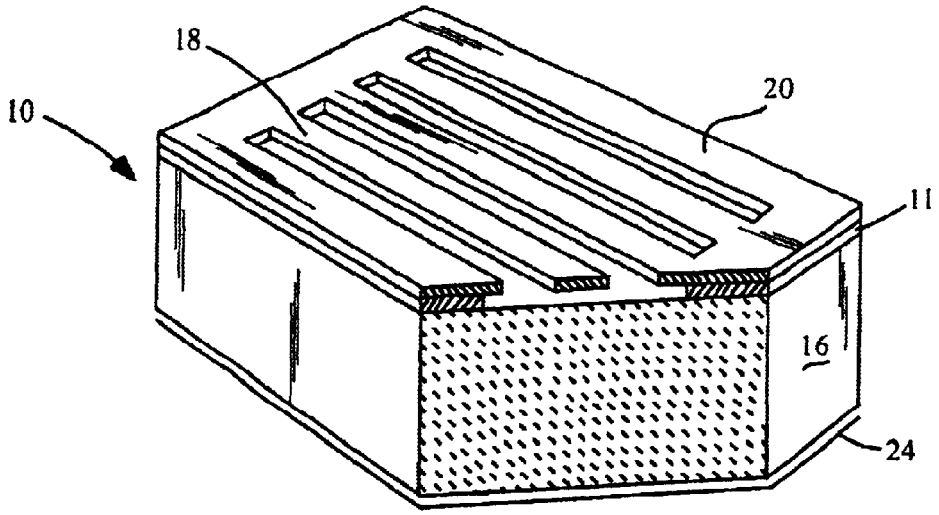
FIG. 2 (Prior Art)
FIG. 2 is a perspective view of a conventional grating light valve (GLV).
Figure 3:
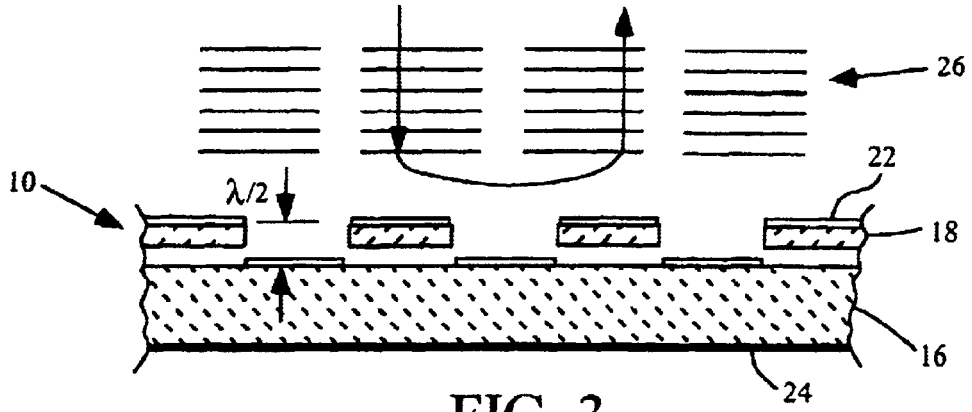
FIG. 3 (Prior Art)
FIG. 3 is a cross sectional view of a conventional GLV of FIG. 2 in a non-diffracting state.
Figure 4:
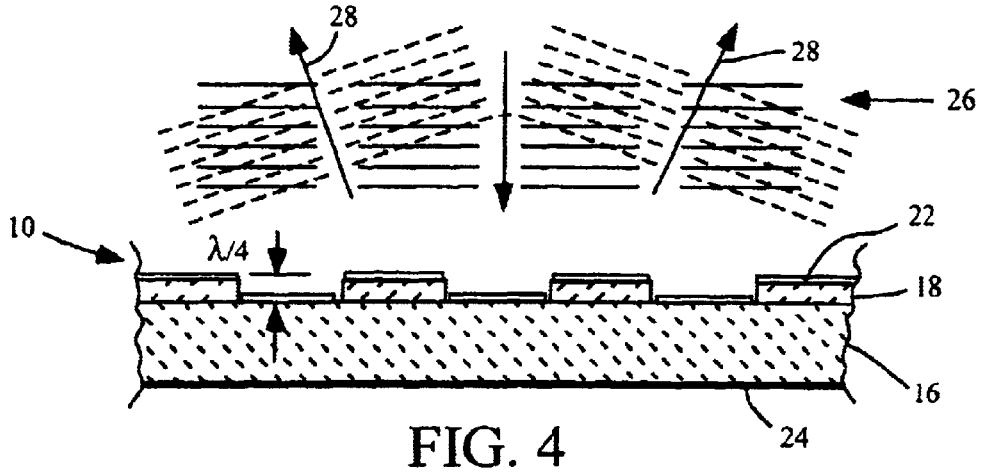
FIG. 4 (Prior Art)
FIG. 4 is a cross sectional view of the conventional GLV of FIG. 2 in a diffracting state.

It is noted that in this embodiment, the gate electrodes generally defining active regions 512 of the base electrodes 504 are non-uniformly spaced across the base electrodes 504. For example, the spacing 510 between a respective pair of gate electrodes (e.g., gate electrodes 508*c* and 508*d*) is small enough to separate gate electrodes in between respective pairs of gate electrodes defining a given active region 512. The spacing 511 between gate electrodes 508 of a respective pair of gate electrodes (e.g., gate electrodes 508*b* and 508*c*) defining a given active region 512 is typically larger than the spacing 510, the spacing dictated by the application of the electron emitting structure. For example, the spacing 511 is dictated by the desired size of a given cathode sub-pixel region of an FED. This is in contrast to the uniform spacing between deflecting elements 18 of the conventional GLV 10 of FIGS. 2–4. It is noted that the various figures are not necessarily drawn to scale.

As illustrated in FIG. 6B, an electron emitting material 602 is deposited on each active region 512 of the base electrodes 504. The electron emitting material 602 may be any low work function material that easily emits electrons, for example, a carbon-based material such as carbon graphite or polycrystalline carbon. Additionally, those skilled in the art will recognize that the emitter material 602 may comprise any of a variety of emitting substances, not necessarily carbon-based materials, such as an amorphous silicon materials, for example.

In one embodiment, the emitter material 602 comprises one or more discrete electron emitting portions that are deposited to substantially cover at least a portion of the active region 512. For example, the emitter material 602 comprises one or more emitter cones (i.e., Spindt tips) deposited on the active region. Where there are more than one emitter cones, the emitter cones are positioned closely together, such that collectively, the many emitter cones form the emitter material 602. In one embodiment, there is no dielectric material or other insulating or separating structure in between individual emitter cones on the surface of the active region. This is in contrast to the individual emitter cones located within individual emitter wells as shown in FIG. 1, each emitter 112 is separated by dielectric material and gate electrode material (located in separate wells).

In some embodiments, rather than using cones or tips of emitter material, the one or more electron emitting portions comprise one or more single wall or multi-wall nanotubes. For example, known single wall nanotubes have a tube-like structure approximately 1–100 $\mu$m tall and 1–7 $\mu$m in diameter, while multiwall nanotubes are approximately 1–100 $\mu$m tall and 10–100 $\mu$m in diameter. One or more nanotubes are deposited on each active region 512. For example, depending on the size of active region 512, several hundred nanotubes may be deposited on a given active region 512. Preferably, the more than one nanotubes are spaced about 1–2 $\mu$m apart such that the height to spacing ratio is about 1:2. It has been found that in some embodiments, if the nanotubes are positioned too close together, the nanotubes shield the electric field, thus, reducing the electric field at the emitting surface. It is noted it is not required that the spacing between nanotubes or emitter cones, or other pieces of discrete emitter portions be consistent. Thus, advantageously, the emitter material may be deposited in a relatively random pattern such that the emitter material 602 substantially covers at least a portion of the active region 612.

It is noted that although the dimensions of the active regions 512 may vary depending on the specific implementation, in preferred embodiments, the active region 512 should be large enough to allow at least one discrete electron emitting portion, e.g., tips, cones, pyramids, nanotubes, etc., to be deposited thereon. Preferably, the individual emitter portions are not separated by gate electrode material or dielectric material therebetween.

Furthermore, in some embodiments, rather than comprising one or more discrete electron emitting portions, the electron emitting material 602 comprises a layer or thin film of emitting material that is applied to at least a portion of the active regions 512. That is, the electron emitting material 502 is a continuous nanocrystalline film layer (e.g., a powder or a molten liquid that hardens) substantially covering at least a portion of the active region 512. This continuous layer is preferably deposited to have a substantially uniform depth across the active region 512. This is a departure from the known tip emitter within well design since the emitter material is spread out over a larger area and additionally lacks a distinct tip or focal point for the electric field, i.e., the depth of the tip emitter varies dramatically from base to tip to base. Furthermore, since there is preferably no (or little) insulating material between the portion of the gate electrode 508 crossing over the active region 512, more emitter material may be deposited on the active region 512.

Additionally, the emitter material 602 is preferably substantially uniformly deposited as a smooth layer having a relatively constant thickness, depth or height on the active region 512, which in some embodiments is helpful in producing a substantially uniform electron emission. In another embodiment, the emitter material 602 may be made such that it has an uneven height, or has bumps, throughout the active region 512.

It is noted that in an alternative embodiment, the active region 512 may be segmented into smaller portions, for example, by one or more ribs of dielectric material extending across the active region 512. Each divided active subregion would be preferably large enough to allow one or more discrete electron emitting portions or a continuously applied material deposited thereon and does not substantially affect the generated electric field. However, as mentioned above, since the gate electrodes 508 in this embodiment are deflecting gate electrodes, this additional insulating material should not interfere with the deflection of the gate electrodes 508 in use.

Generally, it is noted that the dimensions of the various components of the electron emitting structure 500 will vary depending on the specific implementation of the electron emitting structure 500. For example, as used as a cathode plate of an FED, the various components will have the appropriate dimensions to provide the desired size FED. Additionally, it is noted that the various views of FIGS. 5–8B are not necessarily to scale with respect to each other.

In operation, each base electrode 504 is selectively coupled to a drive voltage $V_B$, e.g., a cathode drive voltage in an FED, which is controlled via driving/addressing software. Each gate electrode 508 is selectively coupled to a gate drive or gate voltage $V_G$, which is controlled via driving/addressing software. The driving/addressing software uses known row and column addressing and driving techniques. Thus, in the embodiment illustrated in FIG. 5, each of the base electrodes 504*a* and 504*b* and gate electrodes 508 may be selectably coupled to the respective drive voltages $V_B$ and $V_G$ (illustrated as switches), while non coupled electrodes are grounded.

In operation, as illustrated in FIGS. 7A and 8A, in an "off" or undeflected state, the portion 702 of the gate electrodes 508 spanning over a given base electrode 504 is generally planar with the entire gate electrode 508.

In order to cause an electron emission from an emitter material 602 on a respective active region 512, a voltage potential difference (or simply a voltage potential) is selectively applied between a respective base electrode 504 (e g., base electrode 504*a*) and a respective pair of gate electrodes 508 (e.g., gate electrodes 508*b* and 508*c*) defining the respective active region 512. For example, in one embodiment, a first voltage potential (e.g., $V_B$) is applied to the respective base electrode 504 (e.g., 504*a*) and a second voltage potential (e.g., $V_G$) is applied to the respective pair of gate electrodes 508 (e.g., 508*b* and 508*c*), such that a voltage potential is applied therebetween. Alternatively, a first voltage potential is applied to one of the respective base electrode 504 and the respective pair of gate electrodes 508, while the other of the respective base electrode 504 and the respective pair of gate electrodes 508 is grounded in order to apply the appropriate voltage potential therebetween.

Thus, as is illustrated in FIGS. 7B and 8B, in an "on" or deflected state, the application of a voltage potential between the respective base electrode and the respective pair of gate electrodes causes the portion 702 (also referred to as a deflecting portion) to deflect toward the base electrode 504 underneath, bringing this portion 702 of the gate electrode 508 (e.g., 508*b* and 508*c*) closer to the base electrode 504 (e.g., 504*a*). In this embodiment, the gate electrodes 508 are deflecting electrodes while the base electrodes 504 are non-deflecting electrodes. Thus, the distance 814 between the base electrode 504 and the portion 702 of the gate electrode 508 in the on state (e.g., the left portions of FIGS. 7B and 8B) is effectively reduced compared to the distance 812 between the base electrode 504 and the gate electrode 508 in the off state (e.g., FIGS. 7A, 8A, the right portion of 7B and the right portion of 8B).

In addition to deflecting the portion 702, the application of appropriate voltage potential between the respective base electrode 504 and the respective pair of gate electrodes 508 produces an electric field across a respective active region 512 on the respective base electrode 504 that is sufficient to cause an electron emission from the emitter material 602 deposited on the respective active region 512. The electric field 816 (illustrated in FIG. 8B) produced on the active region 512 is similar to an electric field produced if the spacing between the base electrode 504 and the gate electrode 508 were fixed at the deflected distance (e.g., fixed at distance 814). Therefore, in this embodiment, the electric field 816 at the active region 512 is modified (i.e., geometrically amplified) in comparison to the electric field that would be produced had the gate electrode 508 been fixed in the off state position (e.g., at distance 814). In contrast to conventional FEDs in which the spacing between the gate electrode 114 and the base electrode 107 is fixed, the spacing between the base electrode 504 and the gate electrodes 508 is variable.

If, at the distance 812, a given minimum voltage potential between the base and gate electrodes is required to produce an electric field at the active region 512 sufficient to cause an electron emission from electron emitting material 602, then, at distance 814, a lower minimum voltage potential will provide the same electric field sufficient to cause the electron emission since the base electrode 504 (e.g., 504*a*) and the gate electrodes 508 (e.g., 508*b* and 508*c*) are closer together. Thus, according to several embodiments, advantageously, lower drive voltages may be used to apply the voltage potential in order to produce the same electric field at an active region 516 since the effective distance between the base electrode 504 and the gate electrode 508 is reduced. Furthermore, although the electron emitting structure behaves as though the base electrode 504 and gate electrodes 508 are relatively close together when generating the electric field, in the off state, the base electrodes 504 and the gate electrodes 508 are sufficiently far apart (e.g., at distance 812) that crosstalk is not created at active regions that are intended to be "off". In conventional FED design, the distance between the base electrodes and the gate electrodes is a balance between positioning the electrodes close enough to produce an electric field sufficient to cause an electron emission without requiring high drive voltages and keeping the electrodes far enough apart with a low enough drive voltage in order to prevent crosstalk at adjacent active regions. Advantageously, according to several embodiments of the invention, the base electrode 504 and the gate electrodes 508 are at a distance apart sufficient to avoid crosstalk for active regions 512 in the off state, and yet for active regions 512 in the on state, the base electrode 504 and the gate electrodes 508 are deflected closer than in the off state in order to lower the drive voltage requirements to produce the same electric field.

Thus, in preferred embodiments, the drive voltages (e.g., $V_B$ and $V_G$) selected to produce the appropriate voltage potential between the base and gate electrodes are selected such that at distance 812 (assuming the gate electrodes do not deflect), the electric field produced would be insufficient to produce a complete electron emission from the electron emitting material 602 deposited on the active region 512, while at the deflected distance 814, the electric field 816 produced would be sufficient to produce a complete electron emission 816 from the electron emitting material 602 deposited on the active region 512. Through the selection of emitting materials, such as carbon-based nanotubes, a potential difference of approximately 20 volts between the base electrode voltage $V_B$ and the gate electrode voltage $V_G$ fixed at distance 812 should result in an electric field that causes such an electron emission. However, by allowing deflecting a respective pair of gate electrodes 508 closer to a respective base electrode 504 as described herein, the voltage potential necessary to produce an electric field to cause a complete emission is approximately 10 volts. For example, a voltage potential of −5 volts is selectively applied to a respective base electrode 504, e.g., base electrode 504*a*, where an un-energized state of the base electrode is at 0 volts. At the same time, a voltage potential of +5 volts is applied to the gate electrodes on either side of the active region, e.g., gate electrodes 508*b* and 508*c*, where an un-energized state of the gate electrodes 508 is at 0 volts.

Thus, according to one embodiment, at different active regions 512 of the electron emitting structure 500, there is a voltage potential difference of either 0 volts (0 volts at the base electrode and a corresponding pair of gate electrodes), 5 volts (i.e., −5 volts at the base electrode and 0 volts at the corresponding pair of gate electrodes, or 0 volts at the base electrode and +5 volts at the corresponding pair of gate electrodes) or 10 volts (−5 volts at the base electrode and +5 volts at the corresponding pair of gate electrodes) between the base electrode 504 and the corresponding pair of gate electrodes 508 defining the active region 512. In preferred embodiments, at the distance 814 between the base electrode 504 and the pair of gate electrodes 508, the voltage difference of approximately 10 volts provides an electric field sufficient to cause an electron emission from the emitter material 602 located on a given active region 512, whereas a voltage potential difference of 5 volts or 0 volts will not result in an electron emission. While the values herein are provided for example, it is understood that the voltage values may be other values or may be DC shifted, for example, the gate drive voltage may be +30 volts and the base drive voltage may be +20 volts relative to +25 volts undriven. Alternatively, a voltage potential may be applied between the base electrode and the gate electrodes by applying a voltage potential to one of the base electrode and the gate electrodes, while grounding the other one of the base electrode and the gate electrodes. It is further understood that the specific voltage levels may be varied according to the specific implementation.

Additionally, although the electron emitting structure behaves as though the base electrode 504 and gate electrodes 508 are relatively close together, the electron emitting structure 500 can be easily manufactured since the distance between the base electrode 504 and the gate electrode 508 in the off state is greater than the effective distance during use in the on state.

Thus, in a general sense, an electron emitting structure is provided wherein a given base electrode is positioned relative to a given gate electrode, wherein one of the base electrode and the gate electrode is deflectable relative to the other. Upon the application of a voltage potential between the base electrode and the gate electrode, the deflectable electrode deflects thereby altering the spacing between the two electrodes. This modifies the electric field at an active region of the base electrode, which affects a resulting electron emission from an electron emitting material deposited thereon. For example, in the illustrated embodiment, a portion 702 of the gate electrode 508 is deflectable relative to the base electrode 504, the base electrode 504 having an active region 512 defined thereon. An electron emitting material 602 is deposited on at least a portion of the active region 512. Thus, upon applying a suitable voltage potential difference between the base electrode 504 and to the gate electrode 508, the portion 702 of the gate electrode 508 deflects towards the base electrode such that the distance 814 between the base electrode 504 and the portion 702 of the gate electrode 508 is less than the distance 812 between the two electrodes in an undeflected or off state. This results in an amplification of the electric field at the active region 512 of the base electrode 504, which results in an electron emission 816 from the electron emitting material 602 located on the active region.

It is further noted that the degree of deflection can be controlled by adjusting one or more of the base and gate voltages slightly (i.e., adjusting the voltage potential difference); thus, affecting the electric field and the resulting emission.

According to many embodiments, this is in contrast to known emitting structures since one of the base electrodes 504 and the gate electrodes 508 is deflectable relative to the other. This allows for lower drive voltages to produce an electron emission without crosstalk in adjacent active regions in the off state. This is also in contrast to known GLVs, which include reflective layers and reflect and refract incident light for projection displays, i.e., known GLVs do not include electron emitting materials that emit electrons. Additionally, the spacing between deflecting elements (e.g., gate electrodes 508) in many embodiments is non-uniform across the substrate, as opposed to the uniform spacing of elements 18 of FIGS. 2–4. Furthermore, the deflecting elements (e.g., the gate electrodes 508) are selectively deflected element by element, rather than entire groupings of elements deflected as in conventional GLVs.

Referring to FIGS. 8A (illustrating the off state) and 8B (illustrating in part the on state), using the electron emitting structure as an FED 801, an anode plate 800 is maintained a small and substantially uniform distance above the electron emitting structure 500 (e.g., cathode plate) across the dimensions of the display. The anode plate 800 includes a transparent substrate 802, e.g., a glass substrate. The substrate 802 includes phosphor material is deposited thereon, e.g., phosphors 806 (e.g., red), 808 (e.g., green) and 810 (e.g., blue). A thin metallic anode 804 (e.g., a metallic layer approximately 2000 angstroms thick is formed over the phosphors 806, 808, 810 and the transparent substrate 802. Preferably, the phosphors 806, 808 and 810 extend linearly about the substrate 802 and run parallel to the gate electrodes 508 (the cross section of such phosphor lines illustrated). This gives the FED 801 a SONY® TRINITRON®-like appearance, i.e., the substrate 802 has solid lines of phosphor material (i.e., a striped anode) rather than dots of phosphor materials in traditional pixelized FEDs. However, it is understood that the phosphors 806, 808 and 810 could be formed as lines running parallel to the base electrodes 504, or alternatively, the phosphors could be formed as dots or spots rather than lines on the substrate 802 directly above each corresponding active region 512. It is also understood that the anode 804 may be formed on the substrate 802 with the phosphor material deposited thereover. It is noted that a suitable non-transmissive or opaque (black) substance may be applied to the transparent substrate 802 in between respective phosphors.

In operation, by selectively applying a voltage potential difference between a respective base electrode 504 (e.g., 504*a*) and a respective pair of gate electrodes 508 on opposite sides of a respective active region, e.g., gate electrodes 508*b* and 508*c*, an electric field 816 is produced which causes the emitter material 602 deposited on the respective active region 512 to emit electrons (i.e., electron emission 818) toward and illuminate a corresponding portion (i.e., an anode sub-pixel region) of a corresponding phosphor, e.g., phosphor 806, formed on the anode plate 802 above. Furthermore, as is similarly done in conventional FEDs, in order to accelerate the electron emission 818 toward the phosphor material providing greater brightness of the illuminated anode sub-pixel region of phosphor, a potential is also applied to the anode material 804. This anode potential must be high enough such that electroncs from the electron emission 818 penetrate through the anode 804 and enter the phosphor material.

Such an FED 801 may be driven using pulse width modulation techniques as well known in the art in order to ensure consistent spot size on the anode. For example, pulse width modulation varies the duration that a given voltage potential difference is applied between a base electrode 504 and a respective pair of gate electrodes 508 defining a given active region (and thus, a corresponding anode sub-pixel region or "spot") in order to vary the appearance of the size and brightness of the spot. Additionally, the voltage potential difference may be driven analog in order to slightly alter or offset some of the deflection, which varies the electric field and resulting emission, which varies the size or brightness of the spot.

Furthermore, the FED device incorporates spacers (not shown) that will prevent the anode plate 800 from collapsing on the electron emitting structure 500 in the vacuum. These spacers may be implemented as one or more thin wall segments (e.g., having an aspect ratio of 10–50×1000 $\mu$m) evenly spaced across the substrate. For example, the wall-like or rib-like spacers are preferably parallel to or on the insulating members 506 and located at a desired spacing across the display, e.g., for a 5 inch display, one spacer every 25 mm. Additionally, spacers are preferably located in between pixels (a grouping of three sub-pixel regions, e.g., red, green and blue). Alternatively, these spacers may be implemented as support pillars that are evenly spaced across the substrate 502.

The manufacture of the electron emitting structure 500 may be according to well-known semiconductor manufacturing techniques. For example, the base electrodes 504 are sputtered on the substrate 502 out of a suitable conducting material, e.g., gold, chrome, molybdenum, platinum, etc. A layer of photosensitive dielectric or insulating material, e.g., ceramic or glass, is then spin coated or formed over the substrate 502 and optionally over portions of the base electrodes 504. Next, a layer of conductive gate electrode material is formed over the layer of dielectric material. Then, the gate electrode material layer and the dielectric material layer are patterned using photolithography, for example, and dry etched away to form the gate electrodes 508 crossing over the insulating members 506. Next, the insulating material underneath the portion of the gate electrodes 508 crossing over the base electrodes 504 is then wet etched away. Next, the emitter material 602 is deposited on the active regions 512, e.g., as discrete electron emitting portions or as a continuous layer or film of emitting material.

In a preferred embodiment, the electron emitting structure 500 is implemented as a cathode plate for an FED, e.g., a 40-inch FED. For example, the base electrodes 504 are each about 440 $\mu$m wide and about 1000 angstroms thick extending about the substrate 502, and spaced about 10 $\mu$m apart. The linear insulating members 506 are each about 10 $\mu$m wide and about 5 $\mu$m in height. Each gate electrode 508 is about 10 $\mu$m wide and about 1000 angstroms thick extending across the length of at least a portion of the display and crossing over the base electrodes 504 and the insulating members 506. The spacing 510 is preferably about 10 $\mu$m while the spacing 511 is about 120 $\mu$m. Thus, each active region 512 is about 430 $\mu$m in width and 100 $\mu$m in length. Furthermore, the electron emitting material 602 comprises carbon-based nanotubes having a height of about 1–3 $\mu$m and a diameter of about 1–10 nm, which are deposited to substantially cover at least a portion of the active region 512. It is noted that the dimensions of the various components may be altered depending on the specific implementation without departing from the invention.

Figure 9A:
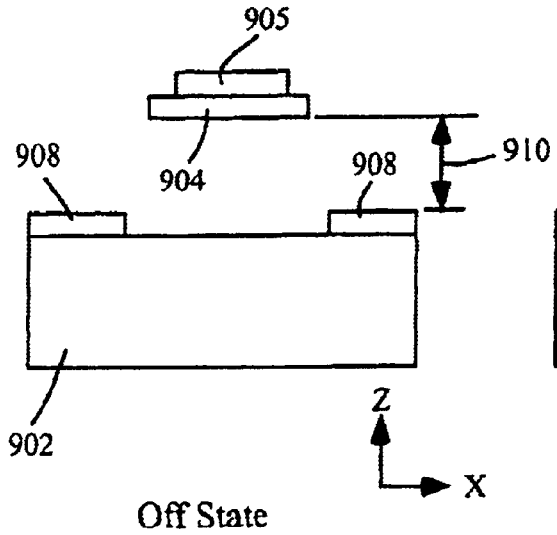
FIGS. 9A and 9B are cross sectional views of another variation of the electron emitting structure of FIGS. 5–8B in the "off" and "on" states, respectively, in which gate electrodes are formed on a substrate while base electrodes are held above the substrate, the base electrodes deflected relative to the gate electrodes in accordance with another embodiment of the invention.
Figure 9B:
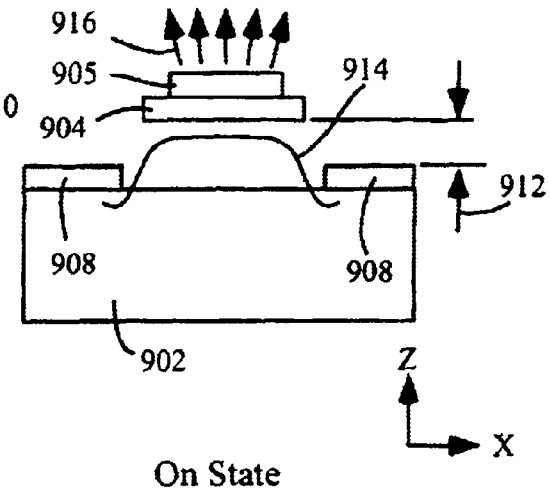

Referring next to FIGS. 9A and 9B, cross sectional views are shown of another variation of the electron emitting structure of FIGS. 5–8B for "off" and "on" states, respectively, in which gate electrodes 908 are formed on a substrate 902 while base electrodes 904 are held above the substrate 902, the base electrodes 904 deflected relative to the gate electrodes 908 in accordance with another embodiment of the invention. In this embodiment, the base electrodes 904 are suspended above the substrate, for example, by suitably shaped insulating members (not shown in FIGS. 9A and 9B). For example, the base electrodes 904 extend parallel to the gate electrodes 908 and are oriented in between a respective pair of gate electrodes 908 formed on the substrate 902. Insulating members (not shown) are formed over the gate electrodes 908 and the substrate 902 and are spaced at intervals and cross over (preferably, are perpendicular to) the gate electrodes 908.

The electron emitting material 905 is deposited on an active region of the base electrode 904, e.g., a deflecting portion of the base electrode 904. The active regions are generally defined as portions of the base electrode 904 that are in between adjacent insulating members. In the off state of FIG. 9A, the base electrode 904 is maintained a distance 910 above the gate electrodes 908 by the insulating members. Upon the application of the appropriate voltage potential difference between to the gate electrodes 908 and the base electrodes 904 (e.g., a first voltage potential is applied to the base electrode 904 and a second voltage potential is applied to the gate electrodes 908), the portion of the base electrode 904 in between adjacent insulating members (i.e., the active region containing the electron emitting material) is deflected toward the gate electrodes 908 to distance 912. At this distance 912, the electric field 914 produced is sufficient to result in an electron emission 916 from the electron emitting material 905.

Similar to the embodiments described above, such deflection alters the distance between the base electrode 904 and gate electrode 908 (i.e., brings them closer) such that lower drive voltages may be used to produce the electric field 914 than would be produced if a higher drive voltage was used at distance 910. Furthermore, since in the off state, the base electrode 504 and the gate electrode 508 are at distance 910, the problem of crosstalk when electrodes are relatively close is avoided.

In this embodiment, the base electrode 904 is the deflecting electrode, while the gate electrodes 908 are the non-deflecting electrodes. A portion of the base electrode is deflected closer to the gate electrodes in order to modify (e.g., amplify) the electric field at the active region where the electron emitting material 905 is located.

Figure 10A:
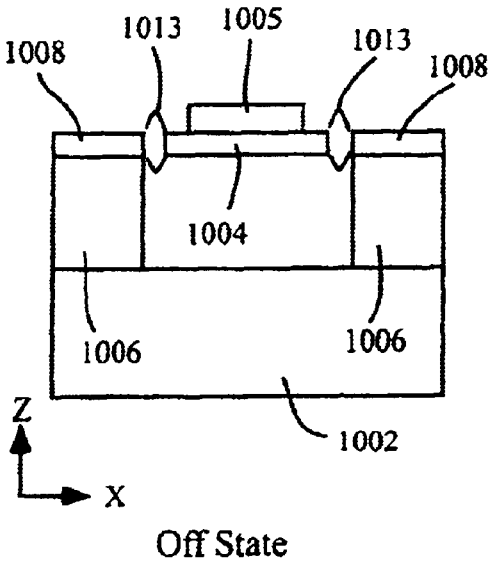
FIGS. 10A and 10B are cross sectional views of a variation of the electron emitting structure of FIGS. 5–8B in the "off" and "on" states, respectively, in which gate electrodes and base electrodes are held above a substrate in plane with each other, the base electrodes deflected relative to the gate electrodes in accordance with another embodiment of the invention.
Figure 10B:
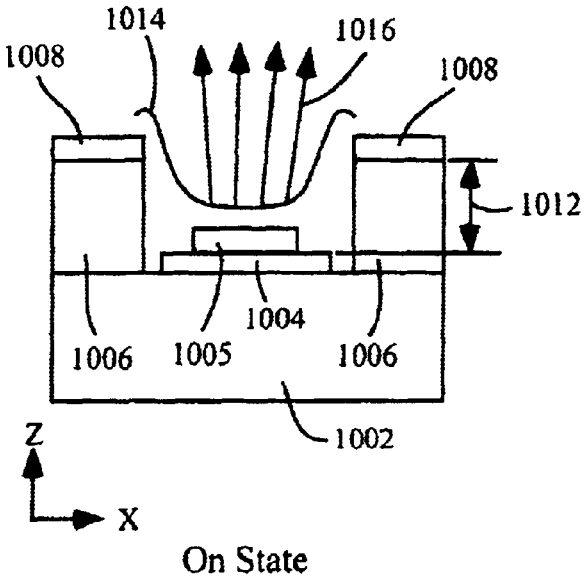

Referring next to FIGS. 10A and 10B, cross sectional views are shown of a variation of the electron emitting structure of FIGS. 5–8B in the "off" and "on" states, respectively, in which gate electrodes 1008 and base electrodes 1004 are held above a substrate 1002, the base electrodes 1004 deflected relative to the gate electrodes 1008 in accordance with another embodiment of the invention. In this embodiment, the gate electrodes 1008 are formed on insulating material, e.g., insulating members 1006, formed on the substrate. The base electrodes 1004 are suspended above the substrate 1002, for example, by suitably shaped insulating members or portions (not shown in FIGS. 10A and 10B). For example, the gate electrodes 1008 and base electrodes 1004 are parallel to each other, with base electrodes 1004 formed in between sets of adjacent gate electrodes 1008. Each gate electrode 1008 is formed in an insulating member 1006. Insulating portions (not shown), for example, connecting adjacent insulating members 1006 suspend the base electrodes 1004 above the substrate 1002. These insulating portions and the insulating members 1006 may form a grid, such that the insulating portions extend perpendicular to the insulating members 1006. In this embodiment, the gate electrodes 1008 and the base electrodes 1004 are at the same elevation in the off state, i.e., they are in plane with each other.

The electron emitting material 1005 is deposited on an active region of the base electrode 1004, e.g., a deflecting portion of the base electrode 1004. The active regions are generally defined as portions of the base electrode 1004 that are in between adjacent insulating portions that connect the insulating members 1006. In the off state of FIG. 10A, the base electrode 1004 is maintained in plane (e.g., a horizontal plane) with or at the same elevation as the gate electrodes. A voltage potential difference applied between the base electrode 1004 and gate electrode 1008 if fixed in position would result in an electric field 1013 in between the edges of the base electrode 1004 and each gate electrode 1008. Such an electric field 1013 would not result in a useful emission and leads to arcing.

However, since the base electrode 1004 is deflectable, upon the application of the appropriate voltage potential difference between the gate electrodes 1008 and the base electrode 1004, the deflecting portion of the base electrode 1004 (i.e., the active region containing the electron emitting material) is deflected toward the substrate 1002 away from the gate electrodes 1008 to distance 1012. At this distance 1012, the electric field 1014 produced is sufficient to result in an electron emission 1016 from the electron emitting material 1005.

Similar to the embodiments described above, such deflection alters the distance between the base electrode 1004 and the gate electrode 1008 (i.e., moves them farther apart) such that low drive voltages may be used to produce the electric field 1014. The low drive voltage avoids crosstalk in adjacent active regions. In this embodiment, the electrodes 1004, 1108 may be manufactured in plane while allowing the deflection to provide to spacing between the base electrode 1004 and gate electrodes 1008.

In this embodiment, the base electrode 1004 is the deflecting electrode, while the gate electrodes 1008 are the non-deflecting electrodes. A portion of the base electrode is deflected farther to the gate electrodes in order to modify (e.g., amplify) the electric field at the active region where the electron emitting material 1005 is located.

It is further noted that the electron emitting structures of FIGS. 9A–10B may also be implemented as cathodes of an FED. Additionally, the voltage potential difference may be analog driven to vary the intensity of the electron emission, rather than employing conventional pulse width modulation techniques to vary the intensity.

As described above, an electron emitting structure in accordance with the invention and as variously described herein may be implemented as a cathode plate of an FED or any other application requiring an electron emission, such as an imaging device (X-ray device). In an alternative use, the electron emitting structure is used as a field ionizer, rather than an emitter. For example, as is known, the gate electrode drive voltage is made negative with respect to the base electrode drive voltage.

While the invention herein disclosed has been described by means of specific embodiments and applications thereof, numerous modifications and variations could be made thereto by those skilled in the art without departing from the scope of the invention set forth in the claims.

What is claimed is:

1. An electron emitting structure comprising:

a substrate having base electrodes and gate electrodes coupled thereto;

an insulating material separating an electrically insulating the base electrodes and the gate electrodes;

an electron emitting material deposited on active regions of the base electrodes;

wherein upon applying a voltage potential difference between a respective base electrode and a respective gate electrode, a portion of one of the respective base electrode and the respective gate electrode deflects through electrostatic force positioning the portion of the one of the respective base electrode and the respective gate electrode relative to another one of the respective base electrode and the respective gate electrode such that an electric field is produced at a respective active region sufficient to cause an electron emission from a respective electron emitting material deposited on the respective active region.

2. The structure of claim 1 wherein the applying the voltage potential difference comprises applying a first voltage potential to the respective base electrode and applying a second voltage potential to the respective gate electrode.

3. The structure of claim 1 wherein the positioning the portion of the one of the respective base electrode and the respective gate electrode closer to the other one of the respective base electrode and the respective gate electrode modifies the electric field at the active region.

4. The structure of claim 1 wherein upon the applying the voltage potential difference, the portion of one of the respective base electrode and the respective gate electrode deflects through electrostatic force positioning the portion of the one of the respective base electrode and the respective gate electrode closer to the other one of the respective base electrode and the respective gate electrode.

5. The structure of claim 4 wherein the positioning the portion of the one of the respective base electrode and the respective gate electrode closer to the other one of the respective base electrode and the respective gate electrode amplifies the electric field at the active region.

6. The structure of claim 1 wherein upon the applying the voltage potential difference, the portion of one of the respective base electrode and the respective gate electrode deflects through electrostatic force positioning the portion of the one of the respective base electrode and the respective gate electrode farther from the other one of the respective base electrode and the respective gate electrode.

7. The structure of claim 1 wherein the gate electrodes comprise deflecting gate electrodes, wherein upon the applying the voltage potential difference, a portion of a respective deflecting gate electrode deflects through electrostatic force positioning the portion of the respective deflecting gate electrode relative to the respective base electrode to produce the electric field.

8. The structure of claim 7 wherein the respective base electrode is formed on the substrate and the respective deflecting gate electrode is suspended above the respective base electrode by the insulating material, the deflecting portion of the respective deflecting gate electrode crossing over the respective base electrode.

9. The structure of claim 7 wherein the insulating material comprises insulating members formed in between adjacent base electrodes, the deflecting gate electrodes spanning over the base electrodes and contacting the insulating members.

10. The structure of claim 7 wherein the deflecting gate electrodes are non-uniformly spaced across the substrate.

11. The structure of claim 1 wherein the base electrodes comprise deflecting base electrodes, wherein upon the applying the voltage potential difference, a portion of a respective deflecting base electrode deflects through electrostatic force positioning the portion of the respective deflecting base electrode relative to a respective gate electrode to produce the electric field.

12. The structure of claim 11 wherein the respective gate electrode is formed on the substrate and the respective deflecting base electrode is suspended above the respective gate electrode by the insulating material.

13. The structure of claim 1 wherein the base electrodes comprise deflecting base electrodes, wherein upon applying the voltage potential difference, a portion of a respective deflecting base electrode deflects through electrostatic force positioning the portion of the respective deflecting base electrode farther from the respective gate electrode to produce the electric field.

14. The structure of claim 13 wherein prior to applying the voltage potential difference, the respective deflecting base electrode and the respective gate electrode are aligned in a horizontal plane.

15. The structure of claim 1 wherein an active region is defined as a portion of a base electrode in between a respective pair of gate electrodes.

16. The structure of claim 15 wherein the applying the voltage potential difference comprises, applying the voltage potential difference between the respective base electrode and to each of a respective pair of gate electrodes, a portion of one of the respective base electrode and the respective pair of gate electrodes deflects through electrostatic force positioning the portion of the one of the respective base electrode and the respective pair of gate electrodes relative to the other one of the respective base electrode and the respective pair of gate electrodes to produce the electric field that causes the electron emission.

17. The structure of claim 1 wherein the insulating material comprises insulating members extending linearly across the substrate and between adjacent base electrodes.

18. The structure of claim 1 wherein the deflecting one of the respective base electrode and the respective gate electrode comprises a deflecting ribbon.

19. The structure of claim 1 wherein the deflection of the portion of the one of the respective base electrode and the respective gate electrode allows for a lower minimum voltage potential difference to be applied to produce the electric field at the respective active region.

20. A method of electron emission comprising the steps of:

applying a voltage potential difference between a base electrode and a gate electrode of an electron emitting structure, the base electrode electrically insulated from the gate electrode;

deflecting, as a result of the applying step, a portion of one of the base electrode and the gate electrode to position the portion of the one of the base electrode and the gate electrode relative to another one of the base electrode and the gate electrode; and producing, as a result of the applying and deflecting steps, an electric field at an active region of the base electrode sufficient to cause an electron emission from an electron emitting material on the active region.

21. The method of claim 20 wherein the applying the voltage potential difference comprises:

applying a first voltage potential to the base electrode; and applying a second voltage potential to the gate electrode.

22. The method of claim 20 wherein the deflecting step positions the portion of the one of the base electrode and the gate electrode closer to the other one of the base electrode and the gate electrode modifying the electric field at the active region.

23. The method of claim 20 wherein the deflecting step comprises:

deflecting, as a result of the applying step, the portion of the one of the base electrode and the gate electrode to position the portion of the one of the base electrode and the gate electrode closer to the other one of the base electrode and the gate electrode.

24. The method of claim 23 wherein deflecting step comprises:

deflecting the portion of one of the base electrode and the gate electrode to position the portion of the one of the base electrode and the gate electrode closer to another one of the base electrode and the gate electrode amplifying the electric field at the active region.

25. The method of claim 20 wherein upon the applying the voltage potential difference, the portion of one of the respective base electrode and the respective gate electrode deflects through electrostatic force positioning the portion of the one of the respective base electrode and the respective gate electrode farther from the other one of the respective base electrode and the respective gate electrode.

26. The method of claim 20 wherein the deflecting step comprises:

deflecting a portion of one of the gate electrode to position the portion of the gate electrode relative to the base electrode.

27. The method of claim 20 wherein the deflecting step comprises:

deflecting a portion of the base electrode to position the portion of the base electrode relative to the gate electrode.

28. The method of claim 27 wherein the deflecting step comprises:

deflecting the portion of the gate electrode to position the portion of the gate electrode farther from the base electrode.

29. The method of claim 20 wherein the applying step comprises:

applying the voltage potential difference between the base electrode and a pair of gate electrodes of the electron emitting structure, the base electrode electrically insulated from the pair of gate electrodes;

wherein the deflecting step comprises:

deflecting the portion of the one of the base electrode and the pair of gate electrodes to position the portion of the one of the base electrode and the pair of gate electrodes relative to the other one of the base electrode and the pair of gate electrodes; and wherein the producing step comprises:

producing the electric field at the active region of the base electrode sufficient to cause the electron emission from the electron emitting material on the active region, the active region defined as a portion of the base electrode in between the pair of gate electrodes.

30. The method of claim 20 wherein the deflecting step allows for a lower minimum voltage potential difference in the applying step to produce the electric field at the active region.

31. A field emission display comprising:

a cathode plate comprising:

a substrate having base electrodes and gate electrodes coupled thereto;

an insulating material separating and electrically insulating the base electrodes and the gate electrodes; and an electron emitting material deposited on active sub-pixel regions of the base electrodes;

wherein upon applying a voltage potential difference between a respective base electrode and a respective pair of gate electrodes, a portion of one of the respective base electrode and the respective pair of gate electrodes deflects through electrostatic force positioning the portion of the one of the respective base electrode and the respective pair of gate electrodes relative to another one of the respective base electrode and the respective pair of gate electrodes such that an electric field is produced at a respective active region sufficient to cause an electron emission from a respective electron emitting material deposited on the respective active region; and an anode plate comprising:

a transparent substrate separated above the cathode plate; and phosphor material coupled to the transparent substrate, portions of the phosphor material corresponding to active sub-pixel regions of the base electrodes, the electron emission illuminating a respective portion of the phosphor material.

* * * * *

UNITED STATES PATENT AND TRADEMARK OFFICE

CERTIFICATE OF CORRECTION

PATENT NO. : 6,747,416 B2
DATED : June 8, 2004
INVENTOR(S) : Barger et al.

It is certified that error appears in the above-identified patent and that said Letters Patent is hereby corrected as shown below:

Column 15,
Line 50, change “an” to -- and --.

Signed and Sealed this

Third Day of May, 2005

JON W. DUDAS
*Director of the United States Patent and Trademark Office*